US005171937A

United States Patent [19]

Aldissi

[11] Patent Number: 5,171,937

[45] Date of Patent: Dec. 15, 1992

[54] METAL-COATED SHIELDING MATERIALS AND ARTICLES FABRICATED THEREFROM

[75] Inventor: Mahmoud Aldissi, Colchester

[73] Assignee: Champlain Cable Corporation, Winooski, Vt.

[21] Appl. No.: 733,948

[22] Filed: Jul. 22, 1991

[51] Int. Cl.[5] ..... H01B 11/18; H01B 11/14

[52] U.S. Cl. ..... 174/36; 174/102 SC

[58] Field of Search ..... 174/36, 102 SC, 35 MS; 219/10.55 D; 342/1

[56] References Cited

U.S. PATENT DOCUMENTS

| | | | |
|---|---|---|---|
| 3,191,132 | 6/1965 | Mayer | 174/36 |
| 4,383,225 | 5/1983 | Mayer | 174/36 X |
| 4,499,438 | 2/1985 | Cornelius et al. | 174/36 X |
| 4,506,235 | 3/1985 | Mayer | 174/36 X |
| 5,047,260 | 9/1991 | Durand | 427/54.1 |

FOREIGN PATENT DOCUMENTS

| | | | |
|---|---|---|---|
| 354131 | 2/1990 | European Pat. Off. . | |
| 3025504 | 3/1981 | Fed. Rep. of Germany | 174/36 |

*Primary Examiner*—Morris H. Nimmo
*Attorney, Agent, or Firm*—Salzman & Levy

[57] ABSTRACT

The present invention features a new shield material useful in the fabrication of shielded wire or cable articles. The conductive core of the wire and cable is layered with a shielding wrapping tape, foil or film. A shielding insulation compound can also be extruded over the conductive wire or cable core. Wire and cable articles containing the new shield material have an extended interference frequency attenuation range resulting from the improved shield layer. The shield material contains metal-coated magnetic particles dispersed within a polymeric binder, such as a fluorocarbon polymer. Other particles of metal such as copper, silver, nickel, manganese, zinc, or silver-coated copper in combination with metal coated and non-coated ferrites and magnetites dispersed within the polymer matrix may also be part of the blend formulation. The shielded wire or cable attenuates both RFI/EMI and microwave/radar interferences. The conductive particles themselves provide the attenuation of the electromagnetic (EM) wave throughout the entire frequency range, while the metal coating on the magnetic particles provide attenuation of the magnetic component of the EM wave at high frequencies exceeding 100 MHz. The shield layer ratio of conductive particles to metal-coating on the ferrite particles can be tuned to provide attenuation within a particularly troublesome frequency range, and can also provide attenuation throughout the entire frequency range.

10 Claims, 2 Drawing Sheets

METAL-COATED SHIELDING MATERIALS AND ARTICLES FABRICATED THEREFROM

FIELD OF THE INVENTION

The invention relates to shielding materials used in the manufacture of wire and cable, and more particularly to coated particles that are integrated into, and dispersed within, a polymeric matrix which is used as a shield layer in multi-layered wire and cable construction.

BACKGROUND OF THE INVENTION

In recent times, ferrite and magnetite particles have been coated with metal to provide conductive materials with good electrical and magnetic properties. It is contemplated by this invention that these types of materials can be used in shielding applications.

The current invention reflects the discovery that, when ferrites are mixed with certain polymers, they provide easily extrudable compounds most suitable for wire and cable fabrication. Such compounds can be directly extruded over bare or insulated wire to form a wire and cable article that attenuates (filters) high frequency interferences.

This invention features wire and cable insulation that can be fabricated for attenuating lower and higher frequency interference signals than were heretofore possible. The extended frequency range encompasses both RFI and EMI frequency signals. The insulation layer of the invention provides both RFI and EMI frequency attenuation in a single layer, without the need for metal braiding.

Wire providing microwave/radar frequency attenuation is referred to in the wire and cable trade as "filter line." Some of these cables are referenced by U.S. Mil Spec. No. Mil-C-85485. The measurement of the attenuation (insertion loss) upon a given wire's performance relates to the effect filter line provides upon interference signals conducted down the wire.

Properly shielded filter line provides protection against radiated EMI. Noise currents and voltages are induced on the conductors of the cables when a radiated field causes interference. Filter line can attenuate such noise when it is shielded by metallic braid or other forms of conventional shield layering. The shielding effect can be measured by transfer impedance techniques.

The present invention seeks to fabricate wire and cable articles that provide protection against both aforementioned effects (i.e., attenuation of signals conducted down the wire, and radiated EMI) utilizing only a single layer of material.

The current invention contemplates a wire or cable construction employing a layer consisting of silver-coated magnetic particles such as ferrites and magnetites dispersed in a polymeric matrix, such as Viton, a fluorinated elastomeric polymer manufactured by DuPont. The magnetic particles are manufactured by various industries such as Steward Mfg. Co. of Tenn., and Fair-Rite Products Corp. of N.Y. The impedance characteristics of the magnetic particles vary depending upon the supplier, fabrication conditions, and composition. Metal coating such as silver is provided by Potters Industries, Inc., of Parsippany, N.J.

High frequency signals conducted down this wire are partially absorbed by the silver-coated particle shield layer. The electromagnetic waves penetrate through this shield layer up to the ferrite particles, and are then dissipated by lattice vibration or photon emission. Protection against radiated EMI is provided by the same shield layer via the percolating structure that consists of a large metallic surface area (silver coatings on each particle). The resulting noise created by the electromagnetic wave, therefore, is absorbed by the silver coating component of the ferrite particles. Thus, a filter line cable is provided which does not require an additional metal braid shield layer. The advantages of such a construction include a savings in cost and weight, and an improved flexibility compared to metal shielded wire utilizing tapes, braids, foils, etc. Weight saving is particularly important in view of the stringent requirements for present day, light-weight space and aeronautical wire and cable.

SUMMARY OF THE INVENTION

In accordance with the present invention, there is provided a new shield material useful in the fabrication of shielded wire or cable articles. The conductive core of the wire and cable is layered with a shielding wrapping tape, foil or film. A shielding insulation compound can also be extruded over the conductive wire or cable core. Wire and cable articles containing the new shield material have an extended interference frequency attenuation range resulting from the improved shield layer. The shield material contains metal-coated ferrite particles dispersed within a polymeric binder, such as a fluorocarbon polymer. Other metal particles such as metal particles of copper, silver, nickel, manganese, zinc, or silver-coated copper in combination with metal coated and non-coated ferrites and magnetites dispersed within the polymer matrix may also be part of the blend formulation. The shielded wire or cable attenuates both RFI/EMI and microwave/radar interferences. The conductive particles themselves provide the attenuation of the electromagnetic (EM) wave throughout the entire frequency range, while the metal coating on the ferrite particles provides attenuation of the magnetic component of the EM wave at high frequencies exceeding 100 MHz. The shield layer ratio of conductive particles to metal-coating on the ferrite particles can be tuned to provide attenuation within a particularly troublesome frequency range, and can also provide attenuation throughout the entire frequency range.

The mixture compound of particulates and polymer binder can be prepared by state-of-the-art compounding techniques and then molded or extruded into various shapes or forms. The magnetic particles can be metal-coated by processes such as that described in European Patent Application, Publication No. 0 354 131 A2, by C. F. Schneider et al, titled "Ferrite Particle Plating System and Electromagnetic Shielding," published Feb. 7, 1990.

BRIEF DESCRIPTION OF THE DRAWINGS

A complete understanding of the present invention may be obtained by reference to the accompanying drawings, considered in conjunction with the subsequent detailed description, in which.

DESCRIPTION OF THE PREFERRED EMBODIMENT

Generally speaking, the invention features new types of shielding materials particularly useful in the fabrication of wire and cable articles. The shielding materials are a blend of metal-coated magnetite and/or metal-coated ferrite particles, and a binding polymer or combination of binding polymers. The shielding materials can be layered, extruded, coated, wrapped, etc., over a conductor or conductive wire core. The metal-coated particles are fabricated by techniques such as electrodeposition, vacuum deposition and other well known methods as described in, for example, the aforementioned European Patent Application, Publication No. 0 354 131 A2. The blend of materials is prepared by state-of-the-art techniques. Other particles of metal such as copper, silver, nickel, manganese, zinc, or silver-coated copper in combination with metal coated and non-coated ferrites and magnetites dispersed within the polymer matrix may also be part of the blend formulation.

Figure 1:
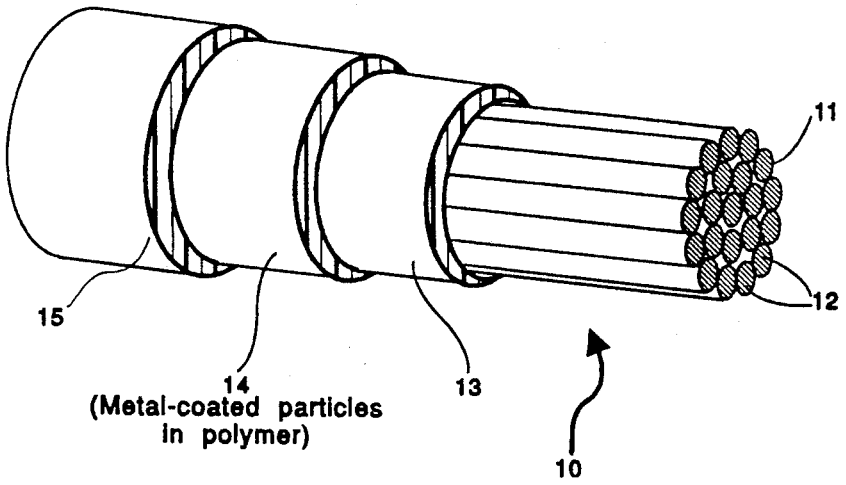
FIG. 1 illustrates a partially cut-away, perspective view of a typical shielded cable article fabricated in accordance with the shield materials of the present invention.

Now referring to FIG. 1, a cable 10 is shown in partial cut-away perspective view. The cable 10 comprises a conductive core member 11, which contains one or more electrically conductive wires 12. The wires 12 can be straight bundled or twisted together. The conductive wires 12 may be bare or each may have a layer of insulation (not shown). The entire conductive core 11 may also be covered by a primary insulation layer 13 of PVDF (Kynar), or other fluorinated polymers.

Shielding material 14 is layered over the primary insulation layer 13. The shielding layer 14 comprises a blend of metal-coated particles in a polymer matrix. The blend of materials in accordance with the invention provides shielding in an extended range heretofore unachievable by a single layer of shielding. The matrix comprises approximately between 10 to 90% by weight of the blend of materials. The metal coating on the particles can range from approximately 5 to 95% of the entire particle weight.

Over the shielding layer 14 is a jacket cover 15. The jacket 15 can comprise a layer of ETFE, cross-linked ETFE, FEP, or other polymers. The jacket 15 can be applied as a wrap of tape.

The shielding layer 14 provides shielding for RFI/EMI or microwave/radar interferences. The metal-coated particles can be bound in a polymer such as Viton, a fluorinated, rubbery polymer manufactured by DuPont Corporation, or in other polymers. Other polymer matrix materials are described in the illustrative examples shown below.

EXAMPLE I

To a conductive core 11 comprising 19×34 strands of tin/copper wire, 22 AWG, having an O.D.=0.03", a layer 13 of primary insulation was applied. The primary insulation consisted of irradiated, cross-linked PVDF (Kynar) of 0.003" wall thickness. Over this was applied a shielding layer 14 comprising a blended material having the following formulation by weight: Viton 13%, poly(ethylene-co-methyl methacrylate) 2%, TAIC cross-linking agent 3%, and silver-coated magnetite (ferric oxide, $Fe_3O_4$) 82% having an average particle size of 31 microns. The silver coating on the particles was on the average of 12.4% of the entire particle weight. The shielding layer 14 was irradiated, cross-linked and extruded over layer 13, and has a thickness of about 0.005". A jacket 15 was wrapped over the shielding layer 14, and comprised cast FEP tape having a wall thickness of approximately 0.0045".

Figure 2:
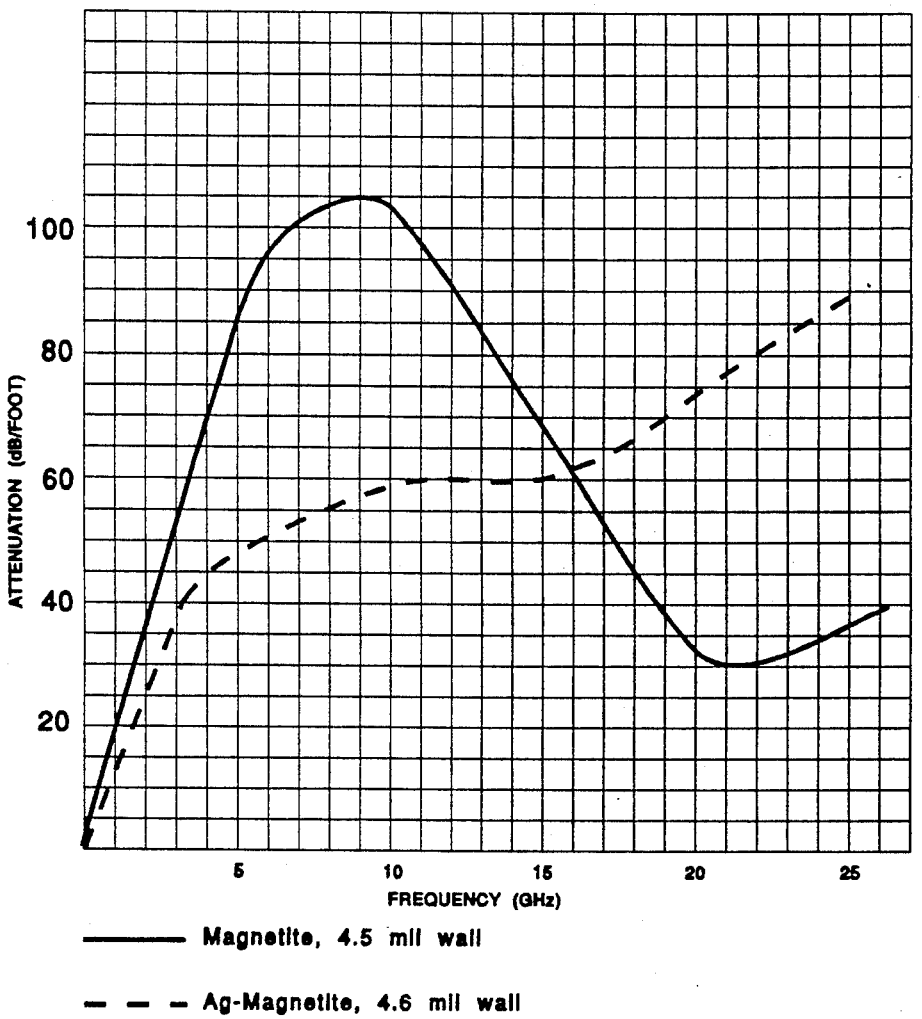
FIG. 2 depicts attenuation test results utilizing a silver-coated magnetite shield layer in the shielded cable of this invention, as compared with a magnetite shield layer that is not metal coated.

Referring to FIG. 2, the attenuation results for the fabricated cable of EXAMPLE I, are shown as a function of frequency. The solid line represents a cable constructed with a non-coated magnetite layer, and the dashed line denotes a cable fabricated with a silver-coated magnetite layer. It will be observed that attenuation increases with frequency with the silver-coated magnetite shielded cable, while the attenuation decreases with the non-coated magnetite shielded cable.

EXAMPLE II

A cable was fabricated in accordance with the materials and procedures designated in EXAMPLE I, with the exception that the material of the shielding layer 14 was blended with Viton 13%, poly(ethylene-co-methyl methacrylate) 2%, TAIC cross-linking agent 3%, and silver-coated fired manganese-zinc ferrite 82% (Steward's #35). The silver coating was on the average 20% of the entire particle weight, and the particle had an average size of 20 microns. The shielding layer 14 was approximately 0.004" thick.

Figure 3:
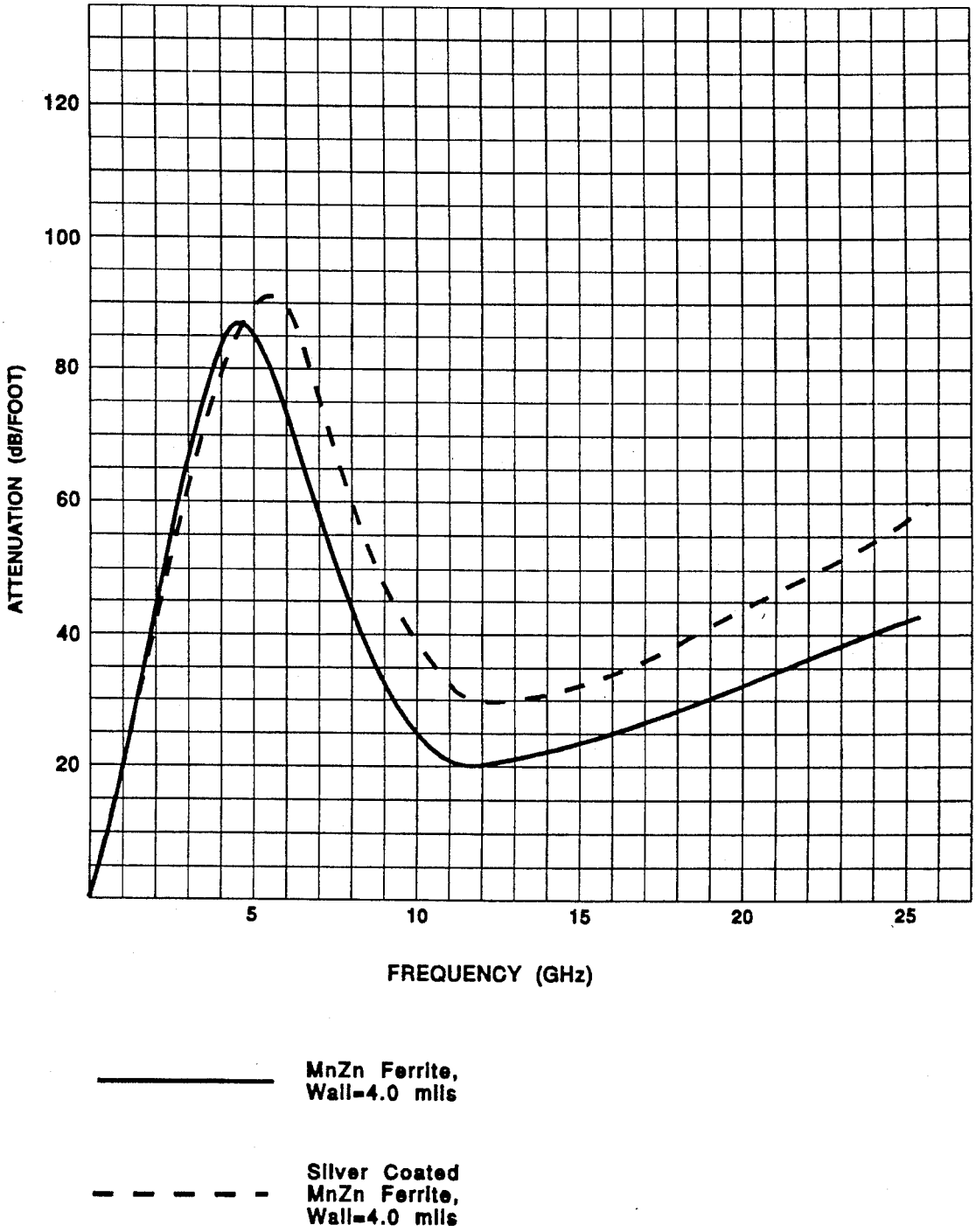
FIG. 3 shows attenuation test results utilizing a silver-coated manganese-zinc ferrite shield layer in the shielded cable of this invention, as compared with a shielded cable using a ferrite shield layer wherein the ferrite particles were not silver-coated.

Referring to FIG. 3, the attenuation results for the cable fabricated according to EXAMPLE II are illustrated. It is observed that the attenuation, plotted as a function of frequency, increases with frequency for the silver-coated ferrite shielded cable, depicted by the dashed line, while the non-coated ferrite shielded cable, shown by the solid line, decreases with frequency. It should also be observed that the attenuation for the silver-coated ferrite shielded cable increases at a faster rate than the silver-coated magnetite cable of EXAMPLE II above 12 GHz. This is evident by the increased slope of the curve.

Since other modifications and changes varied t fit particular operating requirements and environments will be apparent to those skilled in the art, the invention is not considered limited to the example chosen for purposes of disclosure, and covers all changes and modifications which do not constitute departures from the true spirit and scope of this invention.

Having thus described this invention, what is desired to be protected by LETTERS PATENT is presented by the subsequently appended claims.

What is claimed is:

1. A filter line and shielded wire or cable article wherein EMI and RFI shielding and filter line capabilities are respectively provided in a single shielding layer, comprising:

a) a conductive core member;

b) an insulation layer disposed over said conductive core member;

c) a shielding layer overlaying said insulation layer and comprising metal-coated magnetic particles, such as ferrites and magnetites or a combination thereof, dispersed within a polymer matrix and having shielding and filter line capabilities over an extended frequency range from approximately 10 kHz to beyond 1 GHz; and d) a jacket layer disposed over said shielding layer.

2. The shielded wire or cable article wherein EMI and RFI shielding is provided in a single shielding layer, in accordance with claim 1, said shielding layer further comprising:

metal particles of copper, silver, nickel, manganese, zinc or silver-coated copper in combination with metal coated and non-coated ferrites and magnetites dispersed within the polymer matrix.

3. The shielded wire or cable article wherein EMI and RFI shielding is provided in a single shielding layer, in accordance with claim 1, wherein said polymer matrix is selected from a group of polymer materials consisting of: fluorocarbons, acrylates, fluorinated elastomers, fluorinated copolymers, and combinations thereof.

4. The shielded wire or cable article wherein EMI and RFI shielding is provided in a single shielding layer, in accordance with claim 1, wherein said polymer matrix comprises a material having approximately 10 to 90% by weight of the shielding layer.

5. The shielded wire or cable article wherein EMI and RFI shielding is provided in a single shielding layer, in accordance with claim 1, wherein a metal coating disposed upon said metal-coated particles comprises approximately between 5 to 95% by weight of the entire particle weight.

6. A filter line and shielded wire or cable article having EMI and RFI shielding capabilities in a single layer, comprising:

a) a conductive core member;

b) an insulation layer disposed over said conductive core member;

c) a shielding layer overlaying said insulation layer and comprising metal-coated particles selected from a group of metal-coated particles consisting of: ferrite particles, magnetite particles and a combination thereof, said metal-coated particles dispersed within a polymer matrix and having shielding and filter line capabilities over an extended frequency range from approximately 10 kHz to beyond 1 GHz; and d) a jacket layer disposed over said shielding layer.

7. The shielded wire or cable article having EMI and RFI shielding in accordance with claim 6, said shielding layer further comprising:

metal particles of copper, silver, nickel, manganese, zinc or silver-coated copper in combination with metal coated and non-metal coated ferrites and magnetites dispersed within the polymer matrix.

8. The shielded wire or cable article having EMI and RFI shielding in accordance with claim 6, wherein said polymer matrix is selected from a group of polymer materials consisting of: fluorocarbons, acrylates, fluorinated elastomers, fluorinated copolymers, and combinations thereof.

9. The shielded wire or cable article having EMI and RFI shielding in accordance with claim 6, wherein said polymer matrix comprises a material having approximately 10 to 90% by weight of the shielding layer.

10. The shielded wire or cable article having EMI and RFI shielding in accordance with claim 6, wherein a metal coating disposed upon said metal-coated particles comprises approximately between 5 to 95% by weight of the entire particle weight.

* * * * *